United States Patent [19]

Faulkner

[11] 4,112,326

[45] Sep. 5, 1978

[54] NON-UNIFORM DYNODE MESH FOR AN ELECTRON DISCHARGE TUBE

[75] Inventor: Richard Dale Faulkner, Lancaster, Pa.

[73] Assignee: RCA Corporation, New York, N.Y.

[21] Appl. No.: 838,657

[22] Filed: Oct. 3, 1977

[51] Int. Cl.[2] ..... H01J 39/00

[52] U.S. Cl. ..... 313/95; 313/105 R; 250/207

[58] Field of Search ..... 313/95, 103, 104, 105; 250/207, 213 VT; 328/243

[56] References Cited

U.S. PATENT DOCUMENTS

| | | | |
|---|---|---|---|
| 2,433,724 | 12/1947 | Wolfgang | 250/175 |
| 2,824,253 | 2/1958 | Fong et al. | 313/105 |
| 3,119,038 | 1/1964 | Raffan | 313/103 |
| 4,060,747 | 11/1977 | Faulkner | 313/95 |

*Primary Examiner*—Robert Segal
*Assistant Examiner*—Darwin R. Hostetter
*Attorney, Agent, or Firm*—E. M. Whitacre; G. H. Bruestle; R. M. Rodrick

[57] ABSTRACT

An electron discharge tube comprising a plenum having therein a photocathode, an anode, a plurality of spaced apart dynodes, each having an input aperture and an output aperture, the dynodes arranged so as to concatenate electron emissions from the photocathode to the anode, and a conductive mesh overlying each input aperture, is improved by providing non-uniform openings in the mesh whereby relatively greater electrostatic shielding is provided for the dynode surface proximate to the output aperture of a preceding dynode.

6 Claims, 3 Drawing Figures

NON-UNIFORM DYNODE MESH FOR AN ELECTRON DISCHARGE TUBE

The present invention relates to photomultiplier tubes and particularly to those having dynodes which include an electron transmissive mesh in the electron path of the tube.

In one type of photomultiplier tube a series of box-like dynodes, each with an input aperture and an output aperture, are provided. A mesh comprised of conductive material is used for electrostatically shielding the input aperture of each dynode. Such tubes are, e.g., disclosed in U.S. Pat. No. 2,433,724 issued to L. G. Wolfgang on Dec. 30, 1947; 2,824,253 issued to S. G. Fong et al on Feb. 18, 1958; and 3,118,038 issued to W. P. F. Raffan on Jan. 21, 1964. Heretofore, such meshes have been made from a network of conducting elements intersecting to form openings of uniform size. The most widely used mesh is a planar network composed of mutually orthogonal rectilinear conducting elements, i.e., wires.

Such meshes function to permit primary electrons to pass through the member and impinge on the active area of the dynode. The mesh also functions to provide an electrostatic field within the cavity of the dynode to cause the secondary electrons released from the dynode to exit through the output aperture into the next dynode or onto an anode.

As pointed out in my copending U.S. Pat. application Ser. No. 655,165, filed Feb. 4, 1976, the above two functions are highly competitive and compromised against each other. If all of the primary electrons are expected to impinge upon an immediate subsequent dynode, then no mesh should be placed in the path of the primary electrons. The mere presence of a mesh having a plurality of openings therein in the path of the primary electrons raises the probability of primary electrons hitting the mesh and being deflected or stopped from impinging on the next dynode. However, the absence of a mesh means that no secondary electrons can be released from the dynode because the field of the source of the primary electrons, namely a previous dynode, is more negative compared to the next dynode. The negative field of the previous dynode prevents the release of secondary electrons. The above-mentioned patent application discloses a non-uniform mesh shield for the initial and second dynodes, but fails to adequately provide electrostatic shielding of selected portions of the surface of later dynodes in the photomultiplier tube and compromises transmissivity of the mesh portions most proximate to the sidewalls of the box dynodes.

I have ascertained that it is unnecessary to have a uniform optical transmissivity for the mesh over the entire input aperture of the dynode. It has been determined that a relatively large mesh opening is permissible toward or at the output aperture of a dynode and relatively smaller openings are permissible and are desirable at points of the input aperture remote from the output aperture but adjacent to any of the sidewalls of the dynode. The reason for this is the greater need to shield the primary emission surfaces on the sidewalls of the dynode which are adjacent a previous dynode or electrostatically charged member.

SUMMARY OF THE INVENTION

The novel electron multiplier tube comprises a series of hollow secondary dynodes, at least one of which has an input opening for receiving electrons from a previous dynode and an output opening for emitting secondary electrons to a subsequent dynode or to an anode. The input opening of one dynode is covered with a mesh whose transmission varies from a maximum at the edge thereof adjacent the dynode's output opening to a minimum at the opposite edge thereof.

DESCRIPTION OF THE PREFERRED EMBODIMENTS

Figure 1:
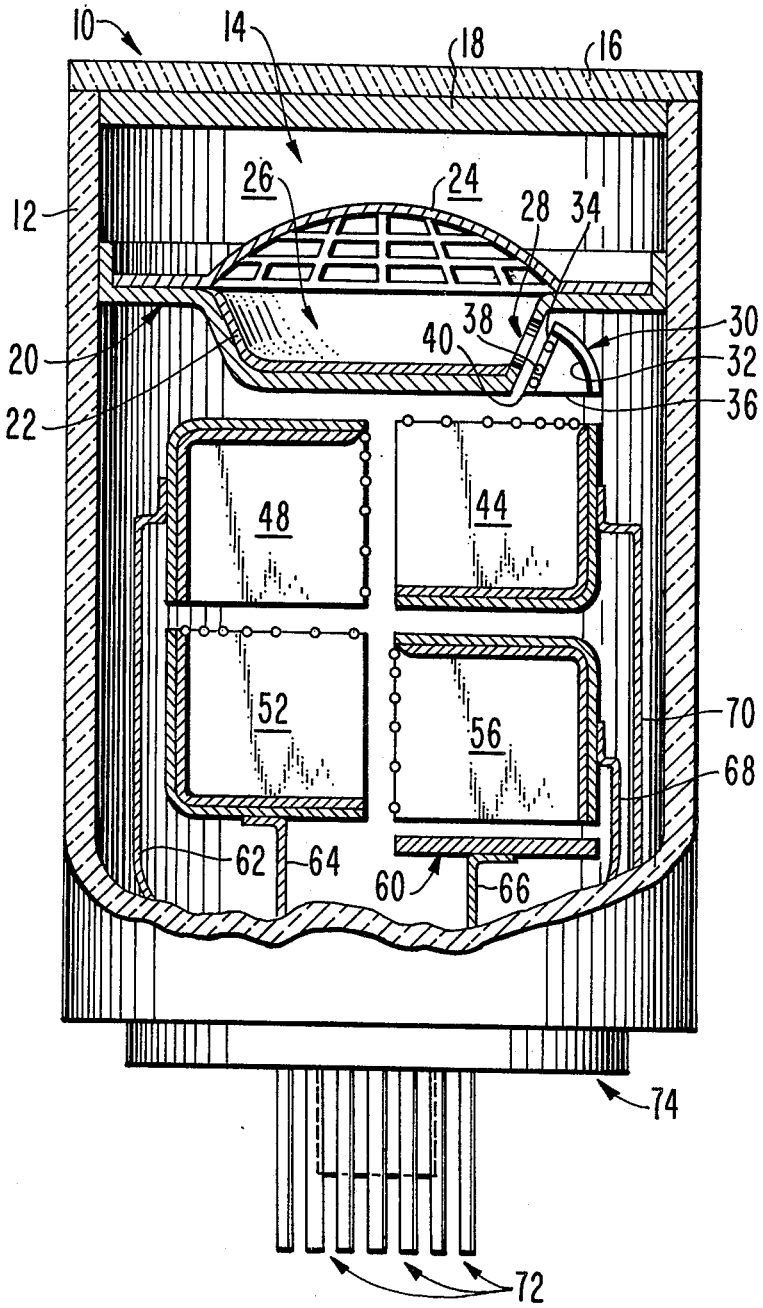
FIG. 1 is a cut-away cross-sectional view of the novel electron discharge device.

Referring to FIG. 1, there is shown an electron discharge device 10 comprising, for example, a cylindrical envelope 12 having an opening 14. Over the opening 14 is a faceplate 16. The faceplate 16 is comprised of an optically transmissive glass. Adjacent the faceplate 16 is a layer 18 of photoemissive material. The photoemissive material of the layer 18 may be cesium antimonide, for example, or any one of a number of other photoemissive materials.

Inside the tube 10 is a primary or first teacup dynode 20 having a secondary-emissive coating 22 adjacent a surface thereof which faces said faceplate 16. The teacup dynode 20 is covered with a dome-shaped electrostatic grid 24. The teacup dynode has an input aperture 26 and an output aperture 28. The dome-shaped electrostatic grid 24 covers the input aperture 26. No covering is over the output aperture 28.

The secondary-emissive coating 22 serves as a source of secondary electrons in response to primary electrons received from the photoemissive layer 18. These secondary electrons are drawn out of the teacup dynode by the electrostatic field on the grid 38 and the dynode 30. The teacup dynode in combination with the grid 24 comprises an electrostatically charged member.

A box-like intermediate dynode 30 having a curved surface 32 and two parallel surfaces perpendicular to said curved surface 32 acts as a receiving member for primary electrons emitted from the teacup dynode 20. The intermediate dynode 30 has an input aperture 34 and an output aperture 36. The input aperture 34 is covered by a planar mesh 38 and a portion 40 of the periphery of the output aperture 36 is formed by the mesh 38. The output aperture 36 issues its secondary electrons as primary electrons into a secondary rectangular box-like dynode 44. Similar box-shaped secondary dynodes 48, 52 and 56 are located within the envelope 12 such that electrons produced by the intermediate dynode 30 are propagated and concatenated by secondary emissions from the secondary dynodes 44, 48, 52 and 56, and are issued upon an anode 60.

Each secondary dynode and the anode has a conductive wire attached thereto for placing an electrostatic charge thereon. The wires 62–70 terminate at the metal pins 72 located at the base 74 of the tube 10.

Figure 2:
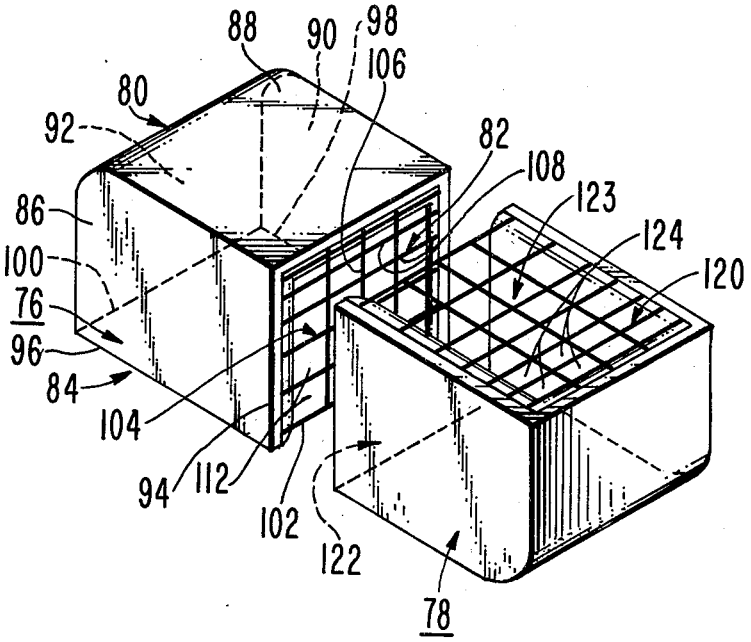
FIG. 2 is a perspective view of a first embodiment of the dynode of the novel device.

In FIG. 2 is shown one specie of the preferred embodiment for the secondary dynodes 44–56. Shown are two cooperating dynodes 76 and 78 in which the dynode 76 receives electrons from the dynode 78.

The dynode 76 is comprised of a rectangular box-like housing 80. The housing 80 may be a conductive metal, for example. Although not shown, the dynode 76, as well as the dynode 78, has the interior surface of the housing coated with a secondary-emissive material. Although the housing 80 shown in FIG. 2 for the dynode 76 is a rectangular box-shaped structure, the housing may be of any particular shape which provides a sufficient secondary emission surface and forms an input aperture 82 and an output aperture 84 immediately adjacent to and at an angle with the input aperture 82.

For this particular specie the housing 80 comprises four walls 86, 88, 90 and 92. The walls 86–90 are joined to form a box-like member such that the input aperture 82 perpendicularly abuts the output aperture 84. The walls 86–90 form a part, namely, three sides, of a periphery 94 of the input aperture 82. Another edge 96 of the wall 86 and another edge 98 of the wall 90, when combined with an exposed edge 100 of the wall 92 provides three sides of the output aperture 84. The fourth side 102 of the output aperture 84 is common with the fourth side 102 of the input aperture 82.

The input aperture 82 is covered by a conductive member 104. The conductive member 104 is comprised of a mesh having a plurality of first elongated members 106 and a plurality of second elongated members 108. The first plurality of elongated members 106 are parallel to each other and coplanar. The second plurality of elongated members 108 are coplanar and parallel to each other and extend between the portion of the periphery 94 provided by the wall 86 and the portion of the periphery 94 provided by the wall 90. The members 106 are orthogonal with the members 108 to form individual apertures 112 in the mask 104.

The second members 108 are not equally spaced. The spacing between them progressively decreases from a maximum at the edge of the input opening 82 adjacent the output opening 84 to a minimum at the opposite edge of the input opening 82. The apertures 112 thus increase in area at points of the input aperture 82 closest to the output aperture 84. Consequently, the transmission of the mesh 104 is greatest adjacent to the output aperture 84 and least at the opposite edge thereof.

The dynode 78 has an input aperture 120 and an output aperture 122. The output aperture 122 has no mesh thereover and is arranged so as to be spaced from and directly in front of the input aperture 82 of the dynode 76. Similar to the dynode 76, the dynode 78 has its input aperture 120 covered with a mesh 123 having openings 124 therein. The dynode 78 has a box-like shape similar to that of dynode 76 and its mesh 123 is constructed similarly to that of the mesh 104 and varies in transmission similarly.

The reason for arranging non-uniform openings 112 of the mesh 104 in the manner above described is to vary the optical and electron transmissivity at specific locations of the input aperture 82 in relation to the proximity of these openings 112 to the adjacent preceding dynode 78 which has a less negative electrostatic field. The dynodes 76 and 78 in FIG. 2 cooperate in that electrons which are produced by secondary emission from the surface of the wall of the dynode 78 are not permitted to travel out of the input aperture 120 because of the mesh 123. The mesh 123 by being connected to the dynode 78 which has a charge thereon is electrostatically charged at the same negative potential. The electrostatic charge on the mesh 123 directs the secondary electrons which are also negative, out of the dynode 78 through its output aperture 122 toward the input aperture 82 of the dynode 76.

The dynode 76 is at an electrostatic potential which is positive, i.e. less negative, with respect to that of the dynode 78. If the dynode 78 is at a potential, for example, of −10v, then the dynode 76 by being at a potential of, for example, −8v, has a greater potential or a more positive potential with respect to the dynode 78. Secondary electrons from the dynode 78 will have a tendency to enter the input aperture 82 of the dynode 76 and leave the output aperture 122 of the dynode 78.

A problem occurs if the input electrons after entering the dynode 76, strike the dynode on the inside surface of the wall 88, for instance. The problem is that if secondary electrons are produced on said inside surface they may be suppressed by the field of the dynode 78. The problem is further complicated provided the input electrons strike near the portion of the periphery 94 provided by the wall 88. When this occurs, secondary electrons are emitted in the vicinity of the portion of the periphery 94 provided by the edge of the wall 88. The mesh 104, in addition to acting as part of a focusing means for directing the secondary electrons out of the dynode 76 through the output aperture 84, then also has to provide electrostatic shielding from the more negative electrostatic field generated by charge on the dynode 78. But for the mesh 104, this electrical field would be able to reach inside the dynode 76. Since the electric field on the dynode 78 is more negative than that of the dynode 76, if allowed to reach into the dynode 76, it would be sufficient to supress the emission of secondary electrons from the surface 88 of the dynode 76.

Figure 3:
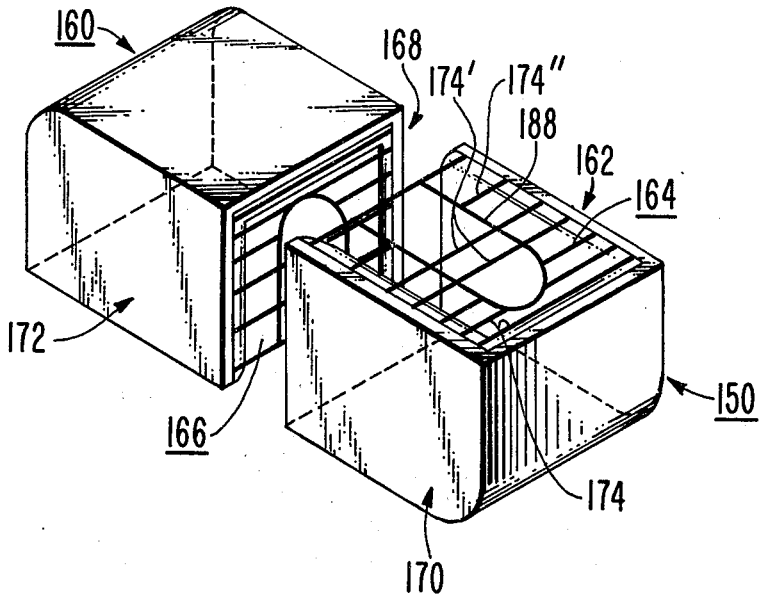
FIG. 3 is a perspective view of a second embodiment of the dynode of the novel device.

Another embodiment of this invention is shown in FIG. 3 which comprises an earlier stage dynode 150 and a later stage dynode 160. These dynodes are similar in all respects to the dynodes 78 nd 76 shown in FIG. 2. This embodiment, however, has distinctly different input apertures from the apertures for the embodiment shown in FIG. 2. Specifically, the dynode 150 has an input aperture 162 covered by what is referred to herein as a proximity-varied density mesh 164 a compared with the progressively-varied density mesh previously described. A similar proximity-varied density mesh 166 covers the input aperture 168 of the dynode 160. These proximity-varied density meshes 164 and 166 are designed to provide relatively smaller openings adjacent the periphery of the input apertures 162 and 168 formed, respectively, by walls of their housings 170 and 172.

In the embodiment shown in FIG. 3 each mesh is comprised of a plurality of elongated conductive members 174 which extend in a parallel non-uniformity spaced fashion across each input aperture 162 and 168 somewhat similar to the meshes 104 and 123 of the dynodes of FIG. 2.

A U-shaped conductive member 188 also comprises a part of the mesh 164 and is disposed with its open end at the edge of the mesh 164 adjacent to the output aperture of the dynode 150 facing the dynode 160. Some of the conductive members 174' extend across the U member 188 while others 174'' are terminated at the U-shaped member 188. The effect of the proximity-varied mesh 164 is to provide greater shielding near the dynode walls and less shielding in the center of the input aperture 164 and at areas near the edge of the output aperture of the dynode.

Although this invention has been described in terms of two distinct wire mesh embodiments covering the input apertures of the respective dynodes, it is to be recognized that other equivalents such as apertured electrically conductive sheets such as metal sheets, for example, are within the scope of this application.

What is claimed is:

1. An electron discharge device comprising an envelope containing a photocathode, an anode, and a plurality of dynodes for propagating and concatenating electron emission from said photocathode to said anode, said dynodes including a series of hollow, box-like secondary dynodes, each of which has an input aperture for receiving electrons from a previous stage and an output aperture for ejecting electrons to a following stage, the input and output apertures of each of said secondary dynodes being adjacent to, and at an angle to, each other, the input aperture of at least one of said secondary dynodes being covered by a conductive, electron-transmissive member, the electron transmission of at least a portion of which varies from a maximum at the edge thereof adjacent to the dynode's output aperture to a minimum at the opposite edge thereof.

2. The device of claim 1 wherein at least one of said members is a mesh having nonuniform sized openings therein varying from a maximum size adjacent to the output aperture to minimum size at the opposite side of the input aperture.

3. The device of claim 1 wherein the input and output apertures of at least one of said secondary dynodes are substantially perpendicular to each other.

4. The device of claim 1 wherein said plurality of dynodes also includes a primary teacup dynode for receiving electrons from said photocathode and an intermediate box-like dynode for receiving electrons from said teacup dynode and emitting electrons to one of said series of secondary dynodes.

5. The device of claim 1 wherein at least one of said members is a proximity-varied type member which comprises a maximum electron transmission portion extending from the edge of said member adjacent to the dynode's output aperture to the central portion of said member, whereby said portion is surrounded except at said edge by a lesser transmission portion of said member.

6. The device of claim 1 wherein said member is of the progressively varied type.

* * * * *

UNITED STATES PATENT AND TRADEMARK OFFICE
CERTIFICATE OF CORRECTION

PATENT NO. : 4,112,326

DATED : September 5, 1978

INVENTOR(S) : Richard Dale Faulkner

It is certified that error appears in the above-identified patent and that said Letters Patent is hereby corrected as shown below:

Column 4, Line 43 "a compared" should be --as compared--

Signed and Sealed this

*Third* Day of *April 1979*

[SEAL]

*Attest:*

RUTH C. MASON
*Attesting Officer*

DONALD W. BANNER
*Commissioner of Patents and Trademarks*